US006544355B1

(12) United States Patent
Nishimura et al.

(10) Patent No.: US 6,544,355 B1
(45) Date of Patent: Apr. 8, 2003

(54) CONTINUOUS CASTING STEEL PLATE FOR PORCELAIN ENAMELING EXCELLENT IN FORMABILITY RESISTANCE TO OCCURRENCE OF BUBBLE OR BLACK POINT, AND ADHESION WITH PORCELAIN ENAMEL

(75) Inventors: Satoshi Nishimura, Kitakyushu (JP); Masayoshi Suehiro, Kitakyushu (JP); Shiro Sanagi, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/786,968

(22) PCT Filed: Jul. 10, 2000

(86) PCT No.: PCT/JP00/04604

§ 371 (c)(1),
(2), (4) Date: Mar. 12, 2001

(87) PCT Pub. No.: WO01/04371

PCT Pub. Date: Jan. 18, 2001

(30) Foreign Application Priority Data

Jul. 13, 1999 (JP) ..... 11-198678

(51) Int. Cl.[7] ..... C22C 38/16; C22C 38/12; C21D 8/00

(52) U.S. Cl. ..... 148/332; 148/320; 148/541; 148/603

(58) Field of Search ..... 148/332, 320, 148/541, 603; 420/93, 127

(56) References Cited

FOREIGN PATENT DOCUMENTS

| | | |
|---|---|---|
| JP | 51-32417 | 3/1976 |
| JP | 52-1288822 | 10/1977 |
| JP | 54-097520 | 8/1979 |
| JP | 59-190331 | 10/1984 |
| JP | 1-275736 | 11/1989 |
| JP | 2-277718 | 11/1990 |
| JP | 11-6031 | 1/1999 |
| JP | 11-100638 | 4/1999 |

*Primary Examiner*—Deborah Yee
(74) *Attorney, Agent, or Firm*—Kenyon & Kenyon

(57) ABSTRACT

A vitreous enamel steel sheet produced by a continuous casting, excellent in formability, bubbling and black spot resistance and adhesiveness, which comprises, in terms of mass %, 0.002% or less of C, 0.05 to 0.2% of Mn, 0.01% or less of Si, 0.004% or less of N, 0.015 to 0.05% of 0, less than 0.01% of P, 0.025% or less of S, 0.02 to 0.04% of Cu, 0.03 to 0.05% of Nb, and 0.03 to 0.07% of V, satisfying the inequality: 0.2>Mn (%)−2.0·O (%)+0.8·V (%)+0.5·Nb (%), and the balance consisting of Fe and unavoidable impurities, and a method for producing the same.

2 Claims, 3 Drawing Sheets

CONTINUOUS CASTING STEEL PLATE FOR PORCELAIN ENAMELING EXCELLENT IN FORMABILITY RESISTANCE TO OCCURRENCE OF BUBBLE OR BLACK POINT, AND ADHESION WITH PORCELAIN ENAMEL

FIELD OF ART

This invention relates to a vitreous enamel steel sheet excellent in enameling properties (bubbling and black spot resistance and adhesiveness) and formability and to a method of producing the same, and is characterized especially by producing the same through continuous casting.

BACKGROUND ART

Vitreous enamel steel sheets have conventionally been produced by ingot casting into capped steel or rimmed steel, primary rolling, hot rolling, cold rolling and, then, decreasing carbon and nitrogen concentrations to several tens of ppm or less through decarbonization by open coil annealing and, in addition, denitrification annealing. The vitreous enamel steel sheets produced following these process steps have, however, a problem of a high manufacturing cost because the ingot casting and primary rolling process is included in the manufacturing steps and the decarbonization/denitrification annealing is required. Another problem is that they are not applicable to final products requiring intensive deep drawing work.

Facing these problems, some vitreous enamel steel sheets produced by continuous casting have been proposed for the purpose of cutting production costs. For example, vitreous enamel steel sheets produced by continuous casting of high oxygen steels, such as the one disclosed in Japanese Examined Patent Publication No. S57-49089, have excellent enameling properties. However, they still have problems that they cannot be used for deep drawing applications due to their poor formability and that they still require decarbonization annealing or decarbonization/denitrification annealing by the open coil method in relation to aging properties.

As a means to overcome the above problems, Japanese Unexamined Patent Publication No. S59-190331 discloses an ultra-low carbon, ultra-low nitrogen vitreous enamel steel sheet produced by continuous casting. The proposed technology consists of controlling concentrations of C and N of a high oxygen steel to an extremely low level of C<30 ppm or C+N<30 ppm in steelmaking processes. The reduction of the C and N concentrations in steel to such a low level, however, inevitably incurs an increase in steelmaking costs and, what is more, even if C+N<30 ppm is achieved, perfectly non-aging steel sheets cannot be obtained.

Some methods to achieve deep drawability and non-aging properties through the addition of Ti or Ti+Rem have been disclosed as countermeasures against the above problem. The technologies disclosed in Japanese Unexamined Patent Publications No. S51-32417 and No. S52-128822 are such examples. The former is a method to enhance deep drawability and obtain non-aging properties by eliminating C and N in solid solution through addition of Ti+Rem to an ultra-low carbon steel and, in parallel, to improve fish scale resistance by forming (Ti, Rem)S by means of S added in a large quantity. By this method, good vitreous enameling properties can be obtained in two-coat enameling in which a strongly adhesive ground coat is used, but bubbling occurs in one-coat enameling and fish scale resistance is insufficient. The method has another problem of a low product yield due to frequent surface defects caused by the addition of Rem. The latter is a method to improve deep drawability by means of a Ti-added ultra-low carbon steel and adhesiveness in two-coat enameling by Cu addition, but it has a problem in that it cannot be applied to steel sheets for one-coat enameling.

In the above situation, after a series of arduous researches, the inventors of the present invention submitted Japanese Patent Application No. H9-274932 regarding a vitreous enamel steel sheet excellent in fish scale resistance and deep drawability and a method to produce the same, proposing a high oxygen vitreous enamel steel sheet containing Nb and V and produced by continuous casting. The proposed technology could provide a steel sheet excellent in deep drawability, but there was a problem that its bubbling and black spot resistance was inferior to totally Al-free high oxygen steels.

DISCLOSURE OF THE INVENTION

The object of the present invention is to overcome the above problems of conventional steel sheets for vitreous enamel use and to provide a deep-drawable and non-aging vitreous enamel steel sheet produced by continuous casting and excellent in bubbling and black spot resistance and adhesiveness in one-coat enameling, and a method to produce the same.

The present invention has been established as a result of wide-ranged studies for the purpose of overcoming the shortcomings of the conventional steel sheets and their production methods. The findings ① to ⑥ described below were reached as a result of examinations of the influences of the following chemical composition and production conditions on formability and enameling properties of vitreous enamel steel sheets.

Chemical composition (in mass %):

0.0005 to 0.0025% of C, 0.05 to 0.35% of Mn, 0.015 to 0.07% of O, 0.005 to 0.06% of Nb, 0.03 to 0.07% of V, 0.05% or less of Cu, 0.05% or less of Si, 0.005 to 0.025% of P, 0.035% or less of S, and 0.0015 to 0.0035% of N.

Production conditions:

A reheating temperature of 1,250 to 1,050° C., a hot rolling finishing temperature of 750 to 950° C., a coiling temperature of 500 to 800° C., a cold reduction ratio of 50% or more, and an annealing at 650 to 850° C. for 1 to 300 min.

Enameling properties:

Fish scale resistance, bubbling and black spot resistance, surface defects and adhesiveness were examined regarding steel sheets coated with an enamel film of 100 μm in thickness by a one-coat enamel treatment after a pickling and a Ni treatment.

① The lower the amounts of C and oxygen, the better the deep drawability.

② A deep drawability of r-value >2.0 is attained by reducing C content to 0.002% or less and adding Nb to 0.03% or more.

③ An aging index of 5 MPa or less is obtained regardless of annealing conditions, when the following conditions are satisfied: C<0.002%, V≧0.03%, and Nb≧0.03%.

④ A good enamel adhesiveness is obtained when the following inequality is satisfied:

$$0.2>T.\ Mn-2.0(O)+0.8(V)+0.5(Nb).$$

⑤ Bubbling and black spots do not occur on enameled steel sheets also when the following inequality is satisfied:

$$0.2>T.\ Mn-2.0(O)+0.8(V)+0.5(Nb).$$

⑥ Hydrogen permeation time, which has good correlation with fish scale resistance, is influenced by the contents of oxygen, Mn, V and Nb, and the larger the contents of these elements, the longer the hydrogen permeation time.

The gist of the present invention, which was established based on the above facts, is as follows:

(1) A vitreous enamel steel sheet produced by continuous casting, excellent in formability, bubbling and black spot resistance and enamel adhesiveness, comprising, in mass %, 0.002% or less of C, 0.05 to 0.2% of Mn, 0.01% or less of Si, 0.004% or less of N, 0.015 to 0.05% of 0, below 0.01% of P, 0.025% or less of S, 0.02 to 0.04% of Cu, 0.03 to 0.05% of Nb, and 0.03 to 0.07% of V, satisfying the inequality 0.2>Mn (%)−2.0·O (%)+0.8·V (%)+0.5·Nb (%), and the balance consisting of Fe and unavoidable impurities.

(2) A method to produce a vitreous enamel steel sheet produced by continuous casting, excellent in formability, bubbling and black spot resistance and enamel adhesiveness, characterized by hot rolling a continuously cast slab, comprising, in mass %, 0.002% or less of C, 0.05 to 0.2% of Mn, 0.01% or less of Si, 0.004% or less of N, 0.015 to 0.05% of O, below 0.01% of P, 0.025% or less of S, 0.02 to 0.04% of Cu, 0.03 to 0.05% of Nb, and 0.03 to 0.07% of V, satisfying the inequality 0.2>Mn (%)−2.0·O (%)+0.8·V (%)+0.5·Nb (%), and the balance consisting of Fe and unavoidable impurities, at a finishing temperature of 800° C. or higher and a coiling temperature of 600 to 800° C., cold rolling the hot rolled strip at a reduction ratio of 60% or more, and then annealing the cold rolled strip at a recrystallization temperature or higher.

BEST MODE FOR CARRYING OUT THE INVENTION

The present invention will be described in detail hereunder.

In the first place, the steel chemical composition will be explained in detail.

It has long been known that the lower the amount of C, the better the formability of steel sheets. In the present invention it is necessary to lower C content to 0.002% or less in order to achieve an aging index of below 5 MPa and an r-value over 2.0. A more preferable C content range is 0.0015% or less. Although it is not necessary to specify a lower limit of C, a practical lower limit is 0.0005% since further reduction of C content results in increased steelmaking costs.

Si content has to be controlled to 0.01% or less since Si is detrimental to enameling properties. A more preferable Si content range for obtaining good enameling properties is 0.005% or less.

Figure 1:
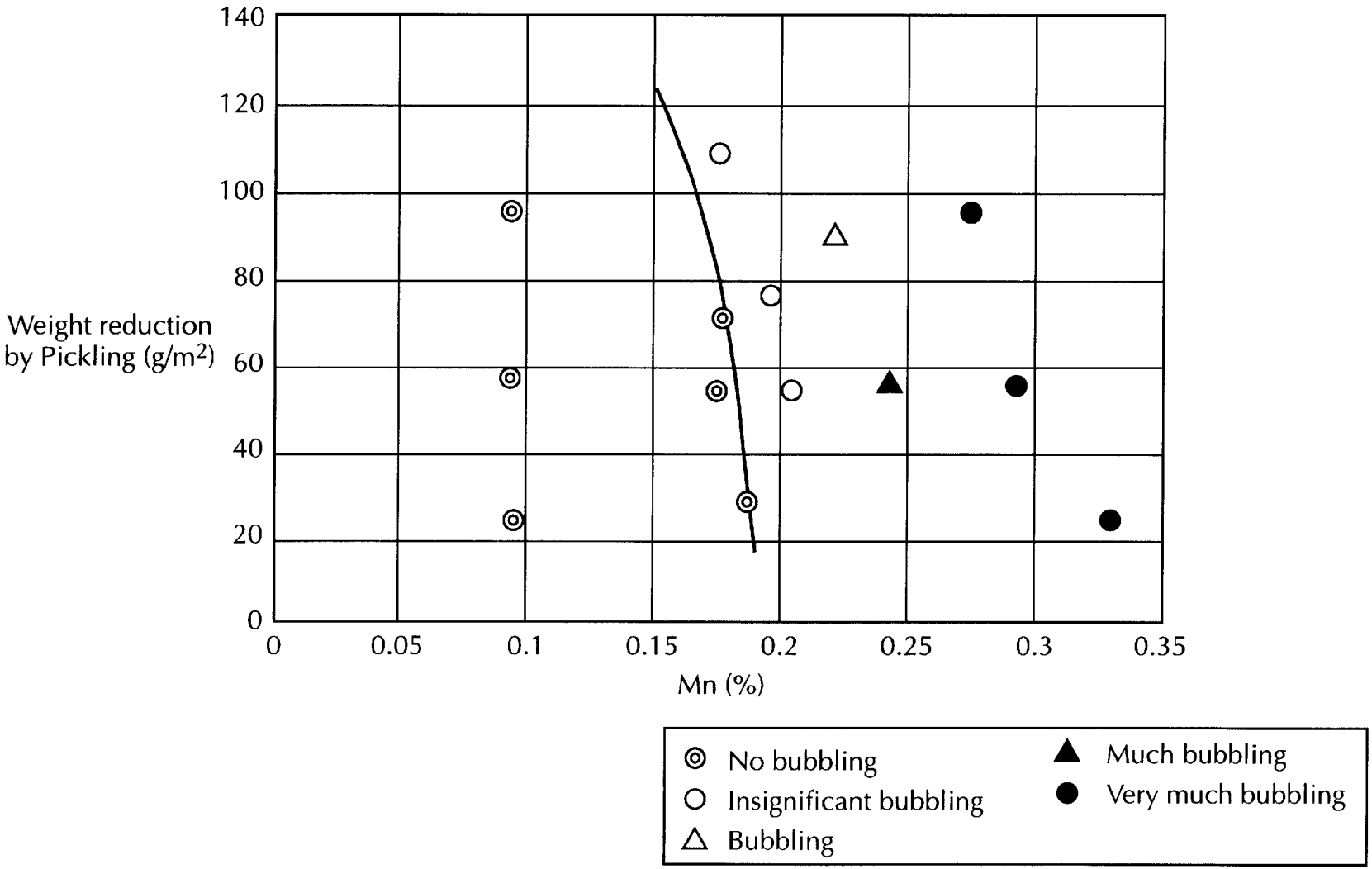
FIG. 1 is a graph showing the influence of Mn on bubbling resistance of Nb—V steels.

Mn is an important element to affect enameling properties in combination with addition of oxygen, V and Nb. Mn also prevents hot shortness caused by S during hot rolling, and 0.05% or more of Mn is required in the steel according to the present invention which comprises oxygen. When the Mn content is high, however, enamel adhesiveness is adversely affected and bubbling and black spots are likely to occur. For this reason, the upper limit of Mn content is defined to be 0.2% from FIG. 1 based on the relationship between Mn content and the occurrence of bubbling under the same condition as in the case of FIG. 4. A more preferable upper limit of Mn content is 0.17%.

Oxygen has direct effects on fish scale resistance and formability. It also affects adhesiveness and bubbling and black spot resistance in combination with the contents of Mn, Nb and V. At least 0.015% of oxygen is necessary for these effects to show but, when its content is high, its high concentration directly deteriorates formability and, besides, deteriorates formability and aging properties indirectly by hindering the effects of Nb and V addition. Hence, its upper limit is set at 0.05%.

N is an interstitial solid solution element like C. When its content exceeds 0.004%, however, formability is lowered even with the addition of Nb and/or V, and the production of non-aging steel sheets becomes impossible. The upper limit of N content is thus specified to be 0.004%. Although it is not necessary to specify a lower limit of N, a practical lower limit is 0.001% since reduction of N content to 0.001% or less is costly by the present steelmaking technologies.

Figure 2:
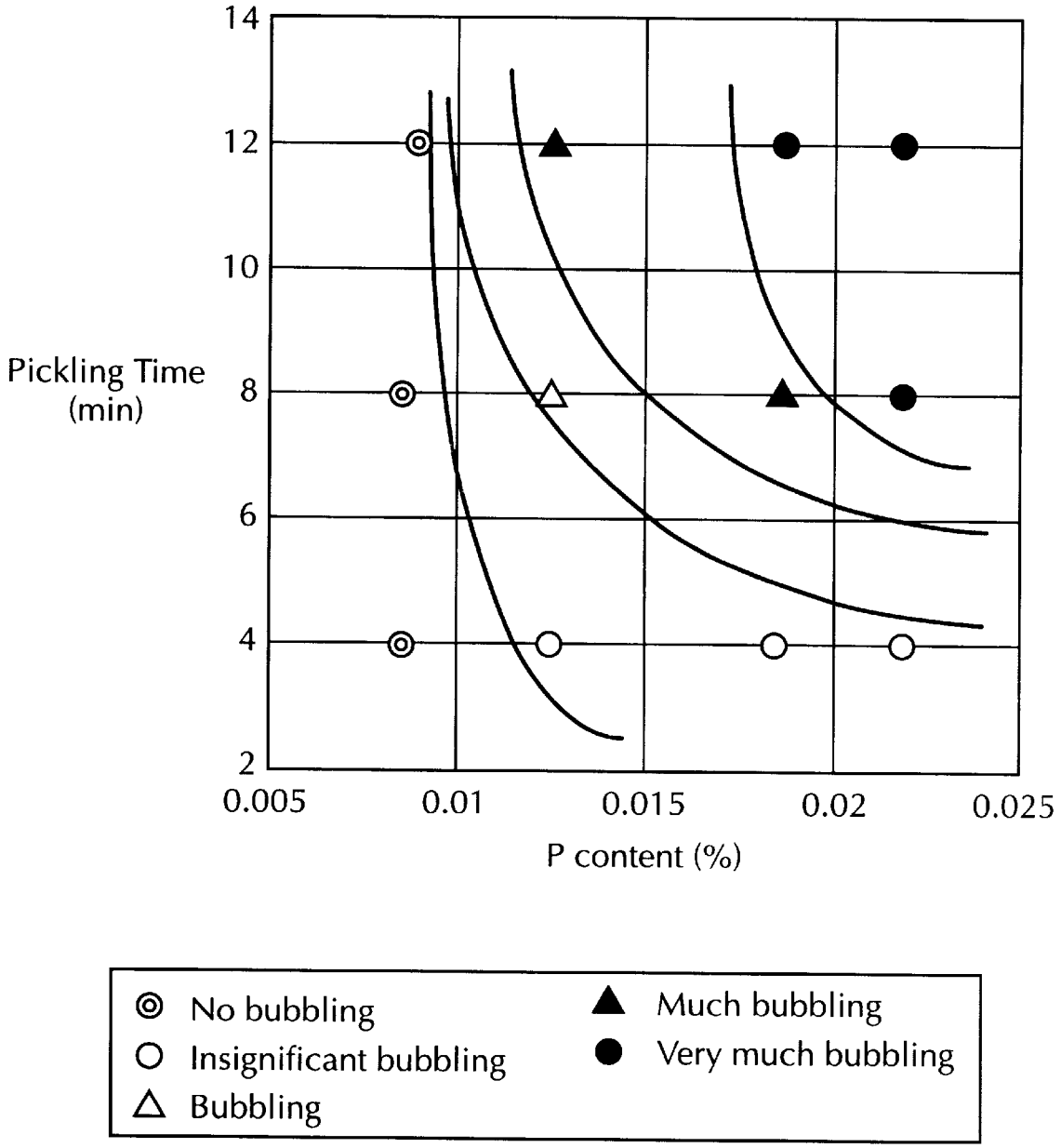
FIG. 2 is a graph showing the influence of P on bubbling resistance of Nb—V steels.

P accelerates pickling speed in a pretreatment process for enameling when its content is 0.01% or more, resulting in an increase in smuts, which give rise to bubbling and black spots. For this reason, P content is limited to below 0.01% in the present invention, based on the relationship between the amount of P and bubbling resistance seen in FIG. 2, under the same condition as that of FIG. 4. A significant improvement of the bubbling and black spots can be achieved by reducing the P content to below 0.01%. The mechanism of this improvement is not clear, but it is supposed as follows: P tends to precipitate at grain boundaries and forms FeP compounds, which give birth to smuts, etc. during pickling and thus tends to cause the bubbling and black spots. For this reason, it is necessary to control the P content to below 0.01% for suppressing the formation of the FeP compounds. When the amount of P is 0.01% or more, the concentration of P at grain boundaries increases, and the FeP compounds form easily. The compounds cause formation of local batteries during the pickling process due to potential difference between the grain boundary and matrix, resulting in locally accelerated pickling speed, and smuts occur in a great quantity during the course of this phenomenon. In order to suppress the occurrence of smuts during pickling, hence, it is extremely important to minimize the formation of the FeP compounds by preventing P from precipitating at grain boundaries.

S increases smuts, during pickling to pretreat the steel sheets prior to enameling, giving rise to the bubbling and black spots, thus it is necessary to keep its content at 0.025% or less.

V is an important element in the present invention. V immobilizes N to prevent N-induced deterioration of deep drawability and that of press formability caused by aging-induced decrease in elongation. A part of V added to steel forms oxides combining with oxygen in the steel and prevents fish scales from occurring. It also has an indirect effect to enhance formability by lowering the amount of oxygen required for suppressing the occurrence of fish scales. For these reasons, the lower limit of V content is set at 0.03%. An addition of V in a great quantity deteriorates enamel adhesiveness and bubbling and black spot resistance and, hence, its upper limit is set at 0.07%.

Nb is another important element in the present invention. It improves deep drawability of steel sheets and renders them non-aging by immobilizing C. Nb added to steel also forms oxides with oxygen in the steel and prevents fish scales from occurring. It also has an indirect effect to enhance formability by lowering the amount of oxygen required for suppressing the occurrence of fish scales. In order to exhibit these effects, at least 0.03% of Nb is necessary. An addition of Nb in a great quantity, however, deteriorates enamel adhesiveness and bubbling and black spot resistance and, hence, its upper limit is set at 0.05%.

Cu is well known to lower pickling speed, during the pickling to pretreat steel sheets prior to enameling. In the present invention, at least 0.02% of Cu is required to fully enjoy the above effect. When the pickling speed lowering effect is too strong, however, enamel adhesiveness is lowered when the pickling time is short since the steel according to the present invention contains extremely small amounts of C and N in solid solution due to Nb and V addition. Thus, the upper limit of Cu is set at 0.04%.

In order to obtain good enamel adhesiveness and bubbling and black spot resistance, contents of Nb, V, Mn and O have to satisfy the inequality $0.2>Mn(\%)-2.0\cdot O(\%)+0.8\cdot V(\%)+0.5\cdot Nb(\%)$. The relationship of the inequality has been defined based on the test results shown in FIGS. 3 and 4 obtained through in-depth examinations of the relationship between steel chemistry and enameling properties.

Figure 3:
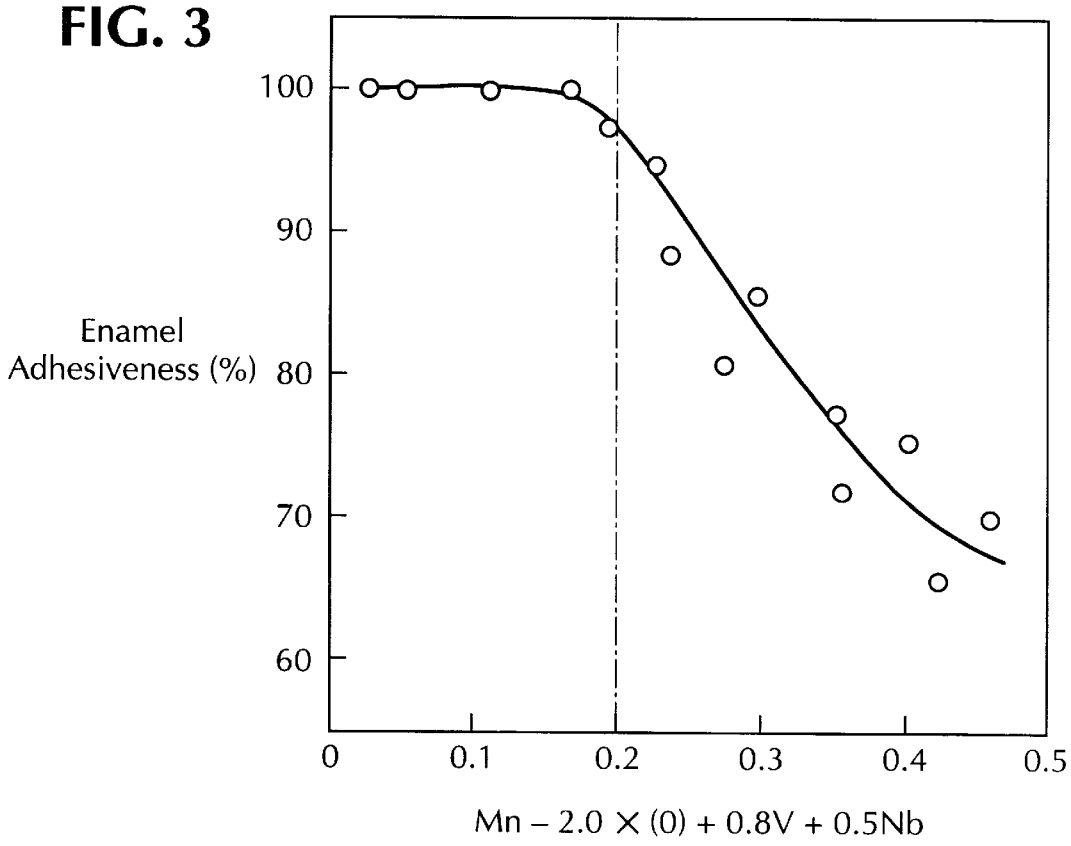
FIG. 3 is a graph showing the relationship between the expression Mn−2.0·O+0.8·V+0.5·Nb and enamel adhesiveness based on the investigations of the one-coat enamel adhesiveness of steel sheets with different chemical compositions.

FIG. 3 shows the relationship between adhesiveness and steel chemistry. Here, the adhesiveness was measured in the following manner: steel sheets of 0.7 mm in thickness were pickled in 15% $H_2SO_4$ at 75° C. for 3 min., Ni-treated in 2% $NiSO_4$ at 70° C. for 3 min. while the pH changed from 2.5 to 3.5, glazed with a glaze for one-coat enameling in the thickness of 100 $\mu$m, baked at 840° C. for 3 min., then hit by a 2.0-kg spherical-headed weight falling from a height of 1 m, and the area of the portion deformed by the impact where the enamel has not peeled off was measured with 169 probing needles. The adhesiveness value in the figure is a mean value of all the specimens of a group having the same value of the expression $Mn-2.0\cdot O+0.8\cdot V+0.5\cdot Nb$.

Figure 4:
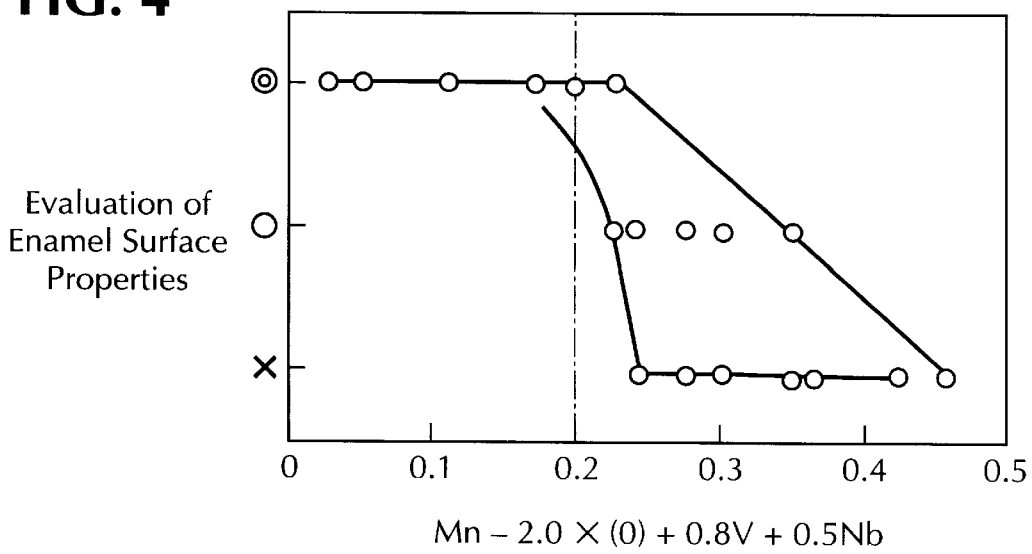
FIG. 4 is a graph showing the relationship between the expression Mn−20·O+0.8·V+0.5·Nb and enamel surface properties based on the investigations of the enamel surface properties of steel sheets with different chemical compositions.

FIG. 4 shows the relationship between the occurrence of bubbling and black spots and steel chemistry. Here, the occurrence of bubbling and black spots was measured in the following manner: steel sheets were pickled in 15% $H_2SO_4$ at 75° C. for 20 min, Ni-treated, enameled, baked, etc. under the same conditions as in FIG. 3, and the occurrence of bubbling and black spots was evaluated by visual inspection of surfaces of the enameled sheets. The symbols mean as follows: ◎ no occurrence of bubbling and black spots, ○ limited occurrence, and X high occurrence.

Since other unavoidable impurities adversely affect steel material properties and enameling properties, it is desirable to minimize their amounts.

Next, the production method will be described hereunder. Steel slabs according to the present invention are produced through continuous casting and the cast slabs are subsequently hot rolled. Since the advantages of the present invention are not affected by reheating temperature, a commonly practiced reheating temperature range of 1,050 to 1,250° C. is applicable. Any hot rolling finishing temperature of 800° C. or higher is acceptable but, in consideration of hot rolling operability, a temperature equal to $Ar_3$ point or higher is preferable. As for coiling temperature, in order to obtain good formability, it is preferable to apply cooling by 50° C. or more immediately after the final rolling pass.

A cold reduction ratio of 60% or more is required for obtaining steel sheets having good deep drawability. When good deep drawability is especially required, a cold reduction ratio of 75% or more is preferable.

As for annealing, advantages of the present invention can be enjoyed either through box annealing or continuous annealing as far as a recrystallization temperature or above it is attained. Continuous annealing is preferable especially for obtaining excellent deep drawability and good enameling properties, which are characteristic of the present invention. Since the steel according to the present invention is characterized in that its recrystallization is completed at 650° C. even within a short annealing time, it is not necessary to anneal at an especially high temperature. A generally suitable temperature range is from 650 to 750° C. for box annealing and from 700 to 800° C. for continuous annealing.

As explained hereinbefore, the steel sheets having the chemical composition of the present invention and produced under the manufacturing conditions according to the present invention are vitreous enamel steel sheets excellent in press formability equal or superior to conventional decarbonized capped steels, not prone to the occurrence of bubbling and black spot defects at direct one-coat enameling, and excellent in enamel adhesiveness, even when they are produced from continuously cast slabs. In applications such as bathtubs and kettles to which an enameling process other than the direct one-coat enameling is employed, the advantages of the invented steel sheet do not change at all and can be equally enjoyed. Note that the conventional ingot-making and primary rolling method is also applicable insofar as the characteristics of the present invention are maintained.

EXAMPLE

Continuously cast slabs having the chemical compositions shown in Table 1 were hot rolled, cold rolled and annealed under the conditions specified in Table 2, then skin pass rolled at a reduction ratio of 1.0%, and the mechanical properties and the enameling properties of steel sheets thus produced were examined. The results are shown also in Table 2.

The mechanical properties were investigated regarding tensile strength, r-value and aging index, using JIS No. 5 test pieces prepared from the annealed and 1.0% skin pass rolled steel sheets. The aging index is shown in the form of stress difference between before and after an aging at 100° C. for 60 min. in the steel sheets subjected to a pre-strain of 10%.

The enameling properties were evaluated after the process steps listed in Table 3. Among the enameling property items, the surface property with respect to bubbling and black spots was tested under the condition of a long pickling time of 20 min. and the evaluation result is indicated as follows: ◎ no occurrence of bubbling and black spots, ○ limited occurrence, and X much occurrence.

The enamel adhesiveness was evaluated under the condition of a short pickling time of 3 min. Because the commonly used P.E.I. adhesiveness test method (ASTM C313-59) is incapable of detecting small difference in the enamel adhesiveness, it was evaluated by hitting test pieces with a 2.0-kg spherical-headed weight falling from a height of 1 m and measuring the ratio of the area where the enamel has not peeled off to the whole deformed area with 169 probing needles.

shown as comparative examples proved inferior in one or both of material properties and enameling properties. This means that a steel sheet excellent in material and enameling properties cannot be produced unless chemical composition and the close relationship among component elements are kept within the ranges specified in the present invention.

TABLE 1

| | Chemical composition (wt %) | | | | | | | | | | | |
|---|---|---|---|---|---|---|---|---|---|---|---|---|
| Steel | C | Si | Mn | P | S | N | O | Cu | Nb | V | Mn-2 × 0 + 0.8 V + 0.5 Nb | Remarks |
| A | 0.0010 | 0.003 | 0.19 | 0.009 | 0.015 | 0.0021 | 0.031 | 0.029 | 0.038 | 0.050 | 0.197 | Examples of |
| B | 0.0015 | 0.001 | 0.18 | 0.008 | 0.012 | 0.0016 | 0.045 | 0.031 | 0.045 | 0.060 | 0.183 | present |
| C | 0.0012 | 0.003 | 0.15 | 0.007 | 0.011 | 0.0020 | 0.028 | 0.026 | 0.033 | 0.040 | 0.143 | invention |
| D | 0.0007 | 0.003 | 0.19 | 0.008 | 0.012 | 0.0025 | 0.032 | 0.030 | 0.039 | 0.055 | 0.189 | |
| E | 0.0010 | 0.004 | 0.19 | 0.007 | 0.017 | 0.0022 | 0.032 | 0.029 | 0.040 | 0.051 | 0.182 | |
| F | 0.0006 | 0.002 | 0.18 | 0.009 | 0.016 | 0.0027 | 0.033 | 0.025 | 0.039 | 0.060 | 0.182 | |
| G | 0.0009 | 0.005 | 0.14 | 0.008 | 0.013 | 0.0023 | 0.045 | 0.026 | 0.043 | 0.052 | 0.113 | |
| H | 0.0035 | 0.008 | 0.22 | 0.015 | 0.015 | 0.0030 | 0.050 | 0.030 | 0.035 | 0.040 | 0.180 | Comparative |
| I | 0.0020 | 0.008 | 0.40 | 0.018 | 0.018 | 0.0035 | 0.033 | 0.030 | 0.035 | 0.042 | 0.381 | examples |
| J | 0.0020 | 0.005 | 0.30 | 0.015 | 0.016 | 0.0050 | 0.050 | 0.031 | 0.036 | 0.035 | 0.246 | |
| K | 0.0019 | 0.012 | 0.25 | 0.014 | 0.016 | 0.0035 | 0.010 | 0.033 | 0.030 | 0.035 | 0.273 | |
| L | 0.0019 | 0.012 | 0.29 | 0.016 | 0.014 | 0.0030 | 0.080 | 0.029 | 0.030 | 0.035 | 0.193 | |
| M | 0.0015 | 0.005 | 0.29 | 0.015 | 0.016 | 0.0028 | 0.045 | 0.030 | 0.022 | 0.035 | 0.243 | |
| N | 0.0019 | 0.005 | 0.29 | 0.017 | 0.020 | 0.0027 | 0.048 | 0.029 | 0.032 | 0.020 | 0.226 | |
| O | 0.0010 | 0.003 | 0.29 | 0.015 | 0.018 | 0.0025 | 0.022 | 0.030 | 0.031 | 0.030 | 0.286 | |
| P | 0.0015 | 0.001 | 0.21 | 0.014 | 0.012 | 0.0016 | 0.045 | 0.031 | 0.045 | 0.060 | 0.183 | |

TABLE 2

| | Hot rolling conditions | | | Cold | | | | | | | Enameling properties | | | |
|---|---|---|---|---|---|---|---|---|---|---|---|---|---|---|
| | Reheating | Finishing | Coiling | reduction | Annealing | Mechanical properties | | | | | Fish scale | Adhesive- | Surface properties, | |
| Steel | temperature (° C.) | temperature (° C.) | temperature (° C.) | ratio (%) | (° C. × min.) | YP (MPa) | TS (MPa) | El (%) | r-value | Al (MPa) | resistance | ness (%) | bubbling and black spots | Remarks |
| A | 1200 | 910 | 750 | 78 | 750 × 1 | 156 | 290 | 52 | 2.2 | 0.0 | ◎ | 100 | ◎ | Examples |
| B | 1150 | 890 | 700 | 80 | 800 × 1 | 149 | 290 | 52 | 2.3 | 0.0 | ◎ | 100 | ◎ | |
| C | 1100 | 900 | 750 | 80 | 750 × 1 | 160 | 300 | 52 | 2.2 | 0.0 | ◎ | 100 | ◎ | of |
| D | 1200 | 890 | 700 | 80 | 750 × 1 | 142 | 289 | 54 | 2.4 | 0.0 | ◎ | 100 | ◎ | present |
| E | 1050 | 915 | 745 | 80 | 775 × 1 | 170 | 295 | 52 | 2.5 | 0.0 | ◎ | 100 | ◎ | invention |
| F | 1250 | 920 | 750 | 78 | 700 × 300 | 165 | 280 | 53 | 2.6 | 0.0 | ◎ | 100 | ◎ | |
| G | 1200 | 900 | 700 | 85 | 680 × 300 | 170 | 290 | 53 | 2.3 | 0.0 | ◎ | 100 | ◎ | |
| H | 1200 | 900 | 700 | 75 | 750 × 1 | 190 | 310 | 48 | 1.6 | 35.0 | ◎ | 100 | ○ | Comparative |
| I | 1200 | 890 | 650 | 80 | 750 × 1 | 180 | 300 | 20 | 2.0 | 3.0 | ◎ | 70 | X | examples |
| J | 1200 | 890 | 700 | 75 | 750 × 1 | 195 | 312 | 47 | 1.7 | 38.0 | ◎ | 88 | X | |
| K | 1250 | 900 | 650 | 80 | 750 × 1 | 160 | 285 | 53 | 2.4 | 0.0 | X | 80 | X | |
| L | 1250 | 915 | 700 | 80 | 700 × 300 | 180 | 295 | 50 | 1.8 | 41.2 | ◎ | 100 | X | |
| M | 1200 | 900 | 700 | 78 | 750 × 1 | 221 | 332 | 46 | 1.7 | 36.5 | ○ | 85 | X | |
| N | 1200 | 895 | 650 | 78 | 750 × 1 | 215 | 329 | 47 | 1.6 | 39.1 | ○ | 85 | X | |
| O | 1150 | 880 | 600 | 78 | 750 × 1 | 175 | 288 | 52 | 2.2 | 3.2 | ◎ | 80 | X | |
| P | 1200 | 890 | 500 | 75 | 750 × 1 | 180 | 325 | 46 | 1.7 | 28.0 | ◎ | 100 | ○ | |

◎: No occurrence
○: Limited occurrence
X: Much occurrence

Fish scale resistance was evaluated through the following accelerated fish scale test: three steel sheets were pretreated through a 3-min. pickling without Ni immersion, glazed with a glaze for direct one-coat enameling, dried, baked at 850° C. for 3 min. in a baking furnace having a dew point of 50° C., and then held for 10 hours in a constant temperature oven of 160° C. The occurrence of fish scales was visually judged and the result is shown in Table 2.

As is clear from the results shown in Table 2, the steel sheets according to the present invention show good r-value and El, and are vitreous enamel steel sheets excellent in aging resistance and enameling properties. The steel sheets

TABLE 3

| Process steps | Description |
|---|---|
| 1 Degreasing | Alkaline degreasing |
| 2 Washing with hot water | |
| 3 Washing with cold water | |
| 4 Pickling | 15% $H_2SO_4$, 75° C. × 3- or 20-min. immersion |

TABLE 3-continued

| Process steps | Description |
|---|---|
| 5 Washing with cold water | |
| 6 Ni treatment | 2% $NiSO_4$, 70° C. × 3-min. immersion |
| 7 Washing with cold water | |
| 8 Neutralization | 2.0% $Na_2SO_4$, 75° C. × 5-min. immersion |
| 9 Drying | |
| 10 Glazing | Direct one-coat glaze, 100 μm in thickness |
| 11 Drying | 160° C. × 10 min. |
| 12 Baking | 840° C. × 3 min. |

Industrial Applicability

The vitreous enamel steel sheets according to the present invention have deep drawability as good as or superior to that of conventional Ti-added highly press-formable steels, and satisfy all the bubbling and black spot resistance, enamel adhesiveness and surface properties required of vitreous enamel steel sheets. What is noteworthy is that the present invention overcomes bubbling and black spot defects, which constituted a problem with the Ti-added steels, that it achieves surface properties equal or superior to those of decarbonized capped steels even when continuous casting is employed, and that it remarkably reduces slab manufacturing costs. The present invention largely contributes also to reducing costs of annealing since it makes it possible to produce steel sheets excellent in press formability and aging resistance through continuous annealing or box annealing, similar to high oxygen steels conventionally produced through continuous casting, without requiring decarbonization annealing or decarbonization/denitrification annealing.

What is claimed is:

1. A vitreous enamel steel sheet produced by continuous casting, excellent in formability, bubbling and black spot resistance and enamel adhesiveness, comprising, in mass %, 0.002% or less of C, 0.05 to 0.2% of Mn, 0.01% or less of Si, 0.004% or less of N, 0.015 to 0.05% of O, below 0.01% of P, 0.025% or less of S, 0.02 to 0.04% of Cu, 0.03 to 0.05% of Nb, and 0.03 to 0.07% of V, satisfying the inequality 0.2>Mn (%)−2.0·O (%)+0.8·V (%)+0.5·Nb (%), and the balance consisting of Fe and unavoidable impurities.

2. A method to produce a vitreous enamel steel sheet produced by continuous casting, excellent in formability, bubbling and black spot resistance and enamel adhesiveness, characterized by hot rolling a continuously cast slab, comprising, in mass %, 0.002% or less of C, 0.05 to 0.2% of Mn, 0.01% or less of Si, 0.004% or less of N, 0.015 to 0.05% of O, below 0.01% of P, 0.025% or less of S, 0.02 to 0.04% of Cu, 0.03 to 0.05% of Nb, and 0.03 to 0.07% of V, satisfying the inequality 0.2>Mn (%)−2.0·O (%)+0.8·V (%)+0.5·Nb (%), and the balance consisting of Fe and unavoidable impurities, at a finishing temperature of 800° C. or higher and a coiling temperature of 600 to 800° C., cold rolling the hot rolled strip at a reduction ratio of 60% or more, and then annealing the cold rolled strip at a recrystallization temperature or higher.

* * * * *